US009636936B2

(12) United States Patent
Neeb et al.

(10) Patent No.: US 9,636,936 B2
(45) Date of Patent: May 2, 2017

(54) DEVICE FOR PRINTING ON AT LEAST ONE REGION OF THE SURFACE OF AN OBJECT

(71) Applicant: HEIDELBERGER DRUCKMASCHINEN AG, Heidelberg (DE)

(72) Inventors: Steffen Neeb, Bensheim (DE); Roland Stenzel, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/040,171

(22) Filed: Feb. 10, 2016

(65) Prior Publication Data

US 2016/0229208 A1 Aug. 11, 2016

(30) Foreign Application Priority Data

Feb. 11, 2015 (DE) ..... 10 2015 202 399

(51) Int. Cl.
*B41J 29/26* (2006.01)
*B41J 3/407* (2006.01)
*B41J 19/06* (2006.01)

(52) U.S. Cl.
CPC ..... *B41J 29/26* (2013.01); *B41J 3/4073* (2013.01); *B41J 19/06* (2013.01)

(58) Field of Classification Search
CPC ..... B41J 29/26; B41J 3/4073
See application file for complete search history.

(56) References Cited

U.S. PATENT DOCUMENTS

| | | | | |
|---|---|---|---|---|
| 5,924,809 | A | 7/1999 | Wotton et al. | |
| 6,004,050 | A | 12/1999 | Rehman et al. | |
| 6,296,093 | B1 | 10/2001 | Norris et al. | |
| 8,882,242 | B2 | 11/2014 | Beier et al. | |
| 2007/0115309 | A1* | 5/2007 | Miura | B41J 2/175 347/9 |
| 2009/0195596 | A1 | 8/2009 | Oka et al. | |
| 2010/0067938 | A1 | 3/2010 | Kemma et al. | |
| 2010/0156970 | A1* | 6/2010 | Ikushima | B05B 12/06 347/8 |
| 2015/0042716 | A1 | 2/2015 | Beier et al. | |
| 2015/0138275 | A1 | 5/2015 | Noell | |

FOREIGN PATENT DOCUMENTS

| | | | |
|---|---|---|---|
| DE | 19505426 | A1 | 8/1996 |
| DE | 19847062 | A1 | 4/2001 |
| DE | 202004002671 | U1 | 4/2004 |
| DE | 102012006371 | A1 | 7/2012 |
| DE | 102012006370 | A1 | 10/2013 |
| EP | 1001184 | A2 | 5/2000 |
| JP | S61195871 | A | 8/1986 |
| JP | H06262583 | A | 9/1994 |

* cited by examiner

*Primary Examiner* — Alessandro Amari
*Assistant Examiner* — Roger W Pisha, II
(74) *Attorney, Agent, or Firm* — Laurence A. Greenberg; Werner H. Stemer; Ralph E. Locher

(57) ABSTRACT

A device for printing on at least one region of a surface of a so-called 3D object, for instance a curved auto body part, includes a manipulator, for instance an articulated-arm robot with six degrees of freedom. The device also includes a system for vibration compensation for the print head. The system includes an active component and a passive component. Manipulator vibration which creates defects in a printed image may thus be effectively avoided.

11 Claims, 1 Drawing Sheet

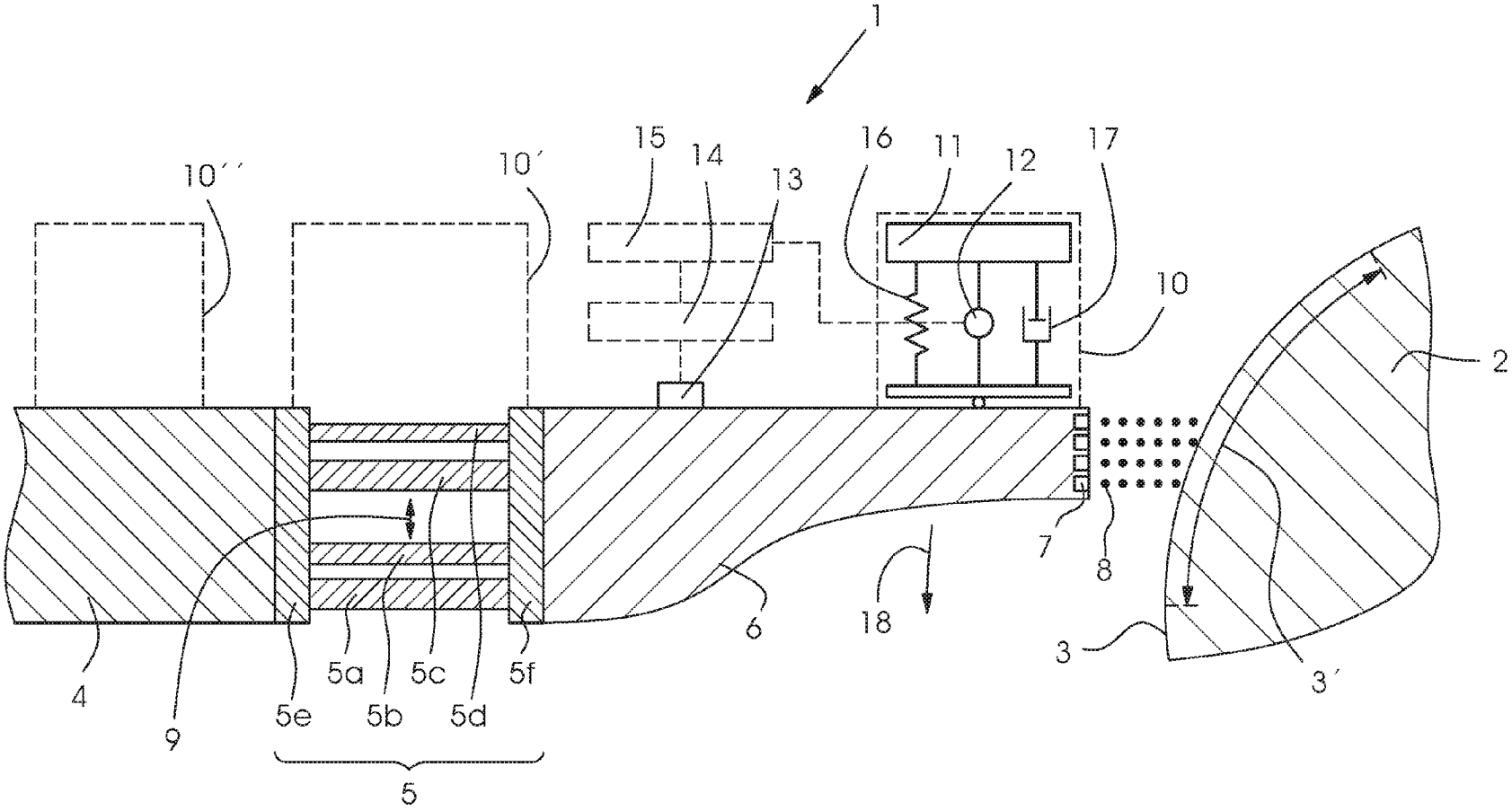
1
2
3
3´
4
5
5a
5b
5c
5d
5e
5f
6
7
8
9
10
10´
10´´
11
12
13
14
15
16
17
18

DEVICE FOR PRINTING ON AT LEAST ONE REGION OF THE SURFACE OF AN OBJECT

CROSS-REFERENCE TO RELATED APPLICATION

This application claims the priority, under 35 U.S.C. §119, of German Application DE 10 2015 202 399.0, filed Feb. 11, 2015; the prior application is herewith incorporated by reference in its entirety.

BACKGROUND OF THE INVENTION

Field of the Invention

The invention relates to a device for printing on at least one region of a surface of an object, in which the device includes a manipulator with a print head.

The technical field of the invention is the field of printing on so-called 3D surfaces by using inkjet printing processes. In general, such surfaces include regions that are not flat but curved.

Description of the Related Art

German Application DE 10 2012 006 371 A1, corresponding to U.S. Application US 2015/0042716, discloses a technical configuration for printing on 3D surfaces wherein a manipulator such as an articulated robot guides a print head along the surface of the object to be printed in multiple adjacent strips and at a printing distance.

German Application DE 10 2012 006 370 A1, corresponding to U.S. Pat. No. 8,882,242 and German Application DE 10 2013 019 359.1, corresponding to U.S. application Ser. No. 14/547,365, filed Nov. 19, 2014, disclose technical configurations that ensure that the strips adjoin in an error-free way and are thus invisible to the human eye.

Due to the fact that vibration of the manipulator and consequently of the print head that is guided by the manipulator cannot be avoided, adjacent ink droplets (print dots) or ink droplets that are deposited on top of one another—for instance to create CMYK color prints—may be imperfectly positioned on the surface, resulting in a flawed printed image. An elimination of such vibration by changing the construction of the manipulator itself would be very difficult and expensive and often basically impossible because the manipulator is a standard industrial robot and a purchased part. In addition, the problem depends on the size of the manipulator, which means that it may arise in particular when large objects such as auto body parts are to be printed on.

European Application EP 1 001 184 A2, corresponding to U.S. Pat. No. 6,269,093, discloses a machining device including a manipulator with three linear axes and a tool head. Vibrations of the manipulator are detected by a sensor and are compensated for by using an actuator. The linear actuator is disposed on the last linear axis in front of the tool.

Japanese Application JP H 06 262 583 likewise discloses a manipulator with sensor-controlled vibration compensation for a gripper. The gripper is fixed to a vibration damper, which is disposed on the last arm of the manipulator. The vibration damper has a movable mass.

The human eye is very perceptive and realizes even minute flaws in a printed image. Thus vibration of the print head during a printing process needs to be avoided. The vibration energy of a system is a function of its vibrating mass. When the active component is directly connected to the manipulator, strong adjustment forces are required to attain sufficient vibration reduction.

SUMMARY OF THE INVENTION

It is accordingly an object of the invention to provide a device for printing on at least one region of the surface of an object, which overcomes the hereinafore-mentioned disadvantages of the heretofore-known devices of this general type and which provides an improved device for printing on 3D objects without flaws by using a manipulator-guided print head even when manipulator vibration occurs.

With the foregoing and other objects in view there is provided, in accordance with the invention, a device for printing on at least one region of a surface of an object. The device comprises a manipulator with a print head and a system for compensating for vibration of the print head. The system includes an active component and a passive component.

The object is preferably a three-dimensional object (in short: a 3D object), i.e. an object which i) substantially extends in three directions in space and has a surface to be printed on including at least one region that may be flat or not flat or ii) substantially extends in only two directions in space and has a surface to be printed on including at least one region that is not flat during the printing process. The region of the surface of the object is preferably a part of the surface. The region may, however, be the entire surface of the object. Within the region, the surface preferably has at least one curve. The object may be a ball, a container, a part of an auto body, or an outer element of an aircraft fuselage.

The manipulator is preferably a robot, in particular an industrial robot. The robot may have articulated joints (rotary kinematics) and/or prismatic joints (linear kinematics). The robot may be an articulated robot, in particular including two to six axes of rotation, preferably five or six axes of rotation. The robot may be a linear arm robot, in particular including two or three linear axes, preferably three linear axes. The robot may be a parallel arm robot.

The print head is preferably an inkjet print head with controllable nozzles for expelling ink droplets in accordance with a text, pattern, logo, image, etc. to be printed.

An advantage of the device of the invention is that it allows 3D objects to be printed on while sufficiently compensating for any manipulator vibration that may affect the printed image. For this purpose, the device includes the vibration compensation system of the invention including two components, one component for active compensation and one component for passive compensation. The division into two components allows each component to be adapted to specific disturbances and to reduce them sufficiently.

In accordance with another feature of the invention, the active component may compensate for low-frequency vibration, i.e. vibration below a frequency threshold. The frequency threshold is preferably between approximately 10 Hz and approximately 200 Hz or between approximately 20 Hz and approximately 50 Hz, in particular between approximately 20 Hz and approximately 30 Hz. The frequency threshold may be approximately 20 Hz, for instance. The frequency threshold may correspond to the manipulator's lowest natural frequency that is relevant for the printed image and the production thereof, i.e. that would create discernible flaws in the printed image (in the case of vibration at this frequency). This division is of particular advantage because typical industrial robots with articulated arms exhibit disturbing vibration in both frequency ranges, which may more effectively be compensated for by the separate devices of the active and passive components. The requirements of a printing process exceed those of other treatments of 3D surfaces because the human eye is very perceptive as far as flaws in patterns are concerned. Thus as it has been unexpectedly found in the course of the development of 3D surface printing, the technical configuration of the prior art for compensating for both ranges by using one component is not suitable in this field. The natural frequency of the print head (and of a portion of a connecting piece between the print head and the manipulator) is below the aforementioned frequency threshold.

The connection (alternatively: the configuration, attachment, suspension) of the print head with the manipulator is preferably "soft," i.e. the natural frequencies of the print head are below the manipulator's lowest natural frequency that is relevant for the printed result. The frequencies that are relevant for the printed result extend as far as a range from approximately 100 Hz to approximately 200 Hz. Due to the type of the connection, the print head is uncoupled from the high-frequency vibration of the robot. At the same time, only small adjustment forces are required for an active compensation because it is only the print head vibration and not additionally the manipulator vibration that is being compensated for. In this way, the uncoupling (in terms of vibration) of the print head and of the printing process from the manipulator and from the movement process is possible.

In accordance with a further feature of the invention, the active component may include an active vibration damper including a mass element and an actuator for moving the mass element. The actuator is preferably embodied as an actuating element that generates force and travel and connects the mass element to the vibrating part. Actuating the actuator causes the mass element to accelerate and the resultant inertial forces effectively counteract the vibration to be compensated for (counter-forces). In accordance with a preferred aspect, the mass of the mass element preferably corresponds to the mass of the print head or of the print head and part of the connecting piece between the print head and the manipulator. Alternatively, the mass of the mass element may range between one tenth of this mass and ten times this mass, up to the order of magnitude of the co-vibrating mass of the manipulator.

In accordance with an added feature of the invention, the actuator may be a plunger coil or a linear motor. Alternatively, the actuator may be a piezo actuator, in particular a piezo stack actuator. The mass element may be a part of the actuator, for instance the moving component thereof.

In accordance with an additional feature of the invention, the active component on the print head may be disposed on a connecting piece or on the manipulator. The preferred configuration is directly on the print head. The active component may include one, two, or three modules, each module acting in an orthogonal spatial direction. Each module may include a mass element and an actuator for moving the mass element.

In accordance with yet another feature of the invention, the system for vibration compensation may include at least one sensor for measuring the vibration of the print head. The sensor may be embodied as an acceleration sensor. The sensor may be disposed directly on the print head. The sensor signals serve to control the actuator. The sensor may include one, two, or three modules, each module measuring in an orthogonal spatial direction, in particular the three spatial components x, y, and z of the acceleration.

In accordance with yet a further feature of the invention, the system for vibration compensation may include a controller and an amplifier connected to the controller (power electronics), wherein the input of the controller is connected to the sensor and the output of the amplifier is connected to the active component. Through the use of the controller/amplifier system, the sensor signals are converted into control signals for the actuator. The control signals are preferably generated in such a way that the disruptive vibration is sufficiently compensated for while the creation of the strips required for producing the print are not affected: advantageously, the head substantially follows the calculated ideal path.

In accordance with yet an added feature of the invention, the passive component may include a connecting piece for fixing the print head to the manipulator.

In accordance with yet an additional feature of the invention, the connecting piece may be embodied as a parallelogram-type suspension. The suspension preferably includes four parallel connecting elements between the manipulator and the print head, allowing the print head to move in at least two spatial directions, i.e. in a plane. The plane is preferably perpendicular to the longitudinal direction of a last arm section of the manipulator. The connecting elements may be embodied as bars having thickness ranges between approximately 5 mm and approximately 10 mm and having length ranges between approximately 20 mm and approximately 200 mm. The suspension is preferably "soft" in the aforementioned plane and "rigid" in a direction perpendicular thereto. Thus the print head has three degrees of freedom in the plane (two translatory and one rotary). A deformation of the parallelogram-type suspension or of a different type of suspension, for instance a suspension on a body made of an elastic material, occurs due to gravity when the print head is at an angle or, alternatively, due to centrifugal forces. This deformation is preferably statically compensated for by suitably controlling the manipulator as a function of two spatial angles.

In accordance with a concomitant feature of the invention, the natural frequency of the print head together with the connecting piece may be lower than the manipulator's lowest natural frequency that is relevant for the printed result.

If a number of print heads or one print head and driers or other combinations of several treatment units are disposed on the manipulator, the combination of these units may advantageously be equipped with a common vibration compensation system. Alternatively, each treatment unit may have a separate active component. In accordance with a further alternative, the print head may have a separate active component, the drier may not have an active component, and both, head and drier, may have a common passive component.

The print head preferably has a small mass compared to the manipulator. The electronics of the print head are preferably disposed on the manipulator (print head "behind" the connecting piece and electronics "in front of" the connecting piece) so that the masses thereof need not be moved for the compensation and the active component may advantageously have small dimensions.

Other features which are considered as characteristic for the invention are set forth in the appended claims.

Although the invention is illustrated and described herein as embodied in a device for printing on at least one region of the surface of an object, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The FIGURE of the drawing is a fragmentary, diagrammatic, sectional view of a preferred exemplary embodiment of a device for printing on an object.

DETAILED DESCRIPTION OF THE INVENTION

Referring now in detail to the single FIGURE of the drawing, there is seen a preferred embodiment of a device 1 for printing on an object 2, in particular on at least one region 3' of the surface 3 of an object. The device includes a manipulator 4 which is embodied as a robot arm and which includes a connecting piece 5 and an inkjet print head 6. The print head has nozzles 7 that expel ink droplets 8 in the direction of the surface of the object. The print head is guided by the manipulator and carries out a movement 18 in strips along the surface at a printing distance.

The print head 6 is connected to an end of the manipulator 4 by the connecting piece 5. The connecting piece 5 forms a passive component of the compensation system. The connecting piece is embodied as a parallelogram suspension including four bars 5*a* to 5*d* and two mounting plates 5*e* and 5*f*. The bars are disposed to form a parallelogram (as indicated by the two "thicker" proximal bars and the two "thinner" distal bars). Due to its "softness," the connecting piece allows the print head to make passive compensation movements relative to the manipulator in a direction indicated by a double-headed arrow 9. The degree of "softness" that fits the requirements may be attained by selecting a suitable material and suitable dimensions (thickness, length).

An active component 10 of the compensation system is disposed on the print head 6 in the form of a compensation module 10. The compensation module 10 includes a mass element 11 and an actuator 12. In addition, a sensor 13 is provided on the print head. The sensor may measure the acceleration of the print head, for instance. The sensor emits signals to a controller 14, which transmits the signals to an amplifier 15, which in turn transmits generated control signals to the actuator.

If the actuator 12 itself has stiffness and damping properties (see reference numerals 16 and 17) or if stiffness and/or spring elements 16 or damping elements 17 are connected in parallel with the actuator 12 in a corresponding way, upon a relative movement between the mass element 11 and the print head 6, corresponding spring and damping forces are effective in parallel with the mass forces. In this case, this needs to be factored in when defining the control algorithm of the controller 14.

The compensation module 10 may also be disposed on the connecting element 5 or on the manipulator 4 (see reference numerals 10' and 10").

The invention claimed is:

1. A device for printing on at least one region of a surface of an object, the device comprising:

a manipulator;

a print head associated with said manipulator; and a system for vibration compensation for said print head, said system including an active component and a passive component;

said active component compensation for low-frequency vibration, and said passive component compensation for high-frequency vibration.

2. The device according to claim 1, wherein the low-frequency vibration includes vibration frequencies below a frequency threshold.

3. The device according to claim 1, wherein the high-frequency vibration includes vibration frequencies above a frequency threshold.

4. The device according to claim 1, wherein said active component includes an active vibration damper with a mass element and an actuator for moving said mass element.

5. The device according to claim 4, wherein said actuator is a linear motor or a plunger coil.

6. The device according to claim 1, wherein said active component is disposed on said print head or on said passive component or on said manipulator.

7. The device according to claim 1, wherein said system for vibration compensation includes at least one sensor for measuring vibration of said print head.

8. The device according to claim 7, wherein said system for vibration compensation includes a controller and an amplifier connected to said controller, said controller having an input connected to said sensor, and said amplifier having an output connected to said active component.

9. The device according to claim 1, wherein said passive component includes a connecting piece for fixing said print head to said manipulator.

10. The device according to claim 9, wherein said connecting piece is constructed as a parallelogram suspension.

11. The device according to claim 9, wherein said print head and said connecting piece together have a natural frequency being lower than a lowest natural frequency of said manipulator being relevant for a printed result.

* * * * *